US011096457B2

(12) United States Patent
Dholakiya

(10) Patent No.: US 11,096,457 B2
(45) Date of Patent: Aug. 24, 2021

(54) SIZE ENHANCER PRECIOUS STONE SETTING

(71) Applicant: H. K. Designs Inc., New York, NY (US)

(72) Inventor: Hasmukh H. Dholakiya, New York, NY (US)

(73) Assignee: H. K. DESIGNS INC., New York, NY (US)

( * ) Notice: Subject to any disclaimer, the term of this patent is extended or adjusted under 35 U.S.C. 154(b) by 80 days.

(21) Appl. No.: 16/680,922

(22) Filed: Nov. 12, 2019

(65) Prior Publication Data

US 2021/0137228 A1 May 13, 2021

(51) Int. Cl.

| | |
|---|---|
| ***A44C 17/02*** | (2006.01) |
| ***A44C 17/04*** | (2006.01) |
| *A44C 17/00* | (2006.01) |

(52) U.S. Cl.

CPC ..... *A44C 17/04* (2013.01); *A44C 17/001* (2013.01)

(58) Field of Classification Search

CPC ..... A44C 17/02; A44C 17/00

USPC ..... 63/26, 27, 29.1, 30, 31; D11/91, 92

See application file for complete search history.

(56) References Cited

U.S. PATENT DOCUMENTS

| | | | | | |
|---|---|---|---|---|---|
| 1,368,909 | A * | 2/1921 | Eliasoff | A44C 17/02 | 63/28 |
| 1,449,158 | A * | 3/1923 | Wittstein | A44C 17/02 | 63/27 |
| 1,941,782 | A * | 1/1934 | Bager | A44C 17/02 | 63/27 |
| 2,273,227 | A * | 2/1942 | Simmons | A44C 17/02 | 63/26 |
| 3,075,367 | A * | 1/1963 | Goodman | A44C 17/00 | 63/26 |
| 2005/0217316 | A1 | 10/2005 | Behr | | |
| 2012/0067083 | A1* | 3/2012 | Huynh | A44C 17/02 | 63/26 |

* cited by examiner

*Primary Examiner* — Jack W Lavinder
(74) *Attorney, Agent, or Firm* — Ostrolenk Faber LLP

(57) ABSTRACT

A size enhancing jewelry setting for a precious stone includes a setting body with a holding portion that is configured to engage and hold the precious stone affixed to the setting body. A faceted plate is supported by the setting body. The faceted plate has a central opening for the passage of a pavilion region of the precious stone therethrough, an upward facing reflecting surface that partially extends below a girdle of the precious stone and which faces a portion of the pavilion region of the precious stone in spaced relationship thereto, and a portion that protrudes peripherally beyond the girdle of the precious stone. The faceted plate is being configured to reflect light that emanates from the pavilion of the precious stone outwardly and upwardly, the reflected light surrounding and extending beyond the precious stone to produce a visual effect of the precious stone being larger in a peripheral dimension thereof than it actually is.

16 Claims, 9 Drawing Sheets

SIZE ENHANCER PRECIOUS STONE SETTING

BACKGROUND OF THE INVENTION

The present invention is generally directed to jewelry mountings or settings for precious stones and, more particularly, to a type of precious stone setting that enhances and enlarges the perceived size of the mounted precious stone, typically a diamond.

Since the dawn of civilization, humans have projected themselves to others through their outerwear and jewelry has been an integral part of the image that people have used to depict themselves to others. Jewelry represents not only beauty and artistic expression, but in many cases, a statement about the person, his or her wealth, status, personality and the like. In particular, jewelry adorned with precious stones, more typically diamonds, has been coveted by virtually every woman since early childhood. Diamonds are extremely scarce and expensive. Therefore, the value and expense factor rises geometrically with the diamond's carat weight. For example, increasing the diametrical size of a round diamond by about 20% to 30% has the effect of doubling the carat size, resulting in many cases in tripling of the value, or even quadrupling the cost of the diamond.

Not surprisingly therefore, for at least a century, the prior art reflects efforts by jewelry designers to provide diamond settings or mountings that appear to enlarge the size of a diamond in casually observed jewelry during the course of human interactions and mingling at social and festive events.

For example, U.S. Pat. No. 1,449,158 that issued to Charles Wittstein in 1923 describes a bezel that is incorporated in a diamond setting to enhance the size of the diamond to the casual observer, by making the diamond appear larger. The bezel blends with the stone. To achieve that effect the bezel is generally disc-shaped with a central round hole that forms a shoulder that supports the diamond, and the top surface of the bezel is formed with a series of polygonal, raised facets that extend inwardly to reflect light that strikes the bezel. The light reflected by the bezel blends with light that is reflected and refracted by the diamond. The mentioned bezel is also supported on a number of prongs, which have a shape and purpose well-known in the jewelry art.

More recently in 2005, U.S. Patent Publication No. 2005/0217316 describes a mounting for a princess cut diamond with vertically convex, upper surfaces that overlap a portion of the stone and which have tapered apexes that create the perception that the corner of the stones are extended, thereby producing an enlarged diamond visual effect.

Nonetheless, the effect that designers have been able to obtain using the prior art devices and methods are limited by the fact that light is reflecting off metallic discs that surround the diamond and it is difficult to recreate with these metallic surfaces the light patterns, brilliance and sparkle that is typically obtained from the light that strikes and bounces within a conventional brilliant cut diamond, which, as is well-known, has over fifty different facets that produce a unique sparkle and brilliance that characterizes and is unique to diamonds.

SUMMARY OF THE INVENTION

Accordingly, it is an object of the present invention to provide a size enhancing disc or plate or washer-shaped bezel for a jewelry setting that receives and surrounds the diamond, with the effect of enlarging its perceived diametrical size, while avoiding the aforementioned drawbacks of the prior art.

It is a further object of the invention to provide a size enhancing setting for diamonds that provides the visually perceivable brilliance and sparkle that is associated with a diamond and more perfectly blends into the diamond to create the overall perception of a larger sized diamond.

Yet another object of the present invention is to provide a size enhancing disc or plate for diamond settings that can be easily mounted to existing settings, so as to maintain the look of an otherwise ordinary and conventional setting.

The foregoing objects of the invention are realized by a size enhancing precious stone setting including a setting body including a holding portion that is configured to engage and hold the precious stone affixed to the setting body; and a faceted plate supported by the setting body, the faceted plate having a central opening for the passage of a pavilion region of the precious stone therethrough, an upward facing reflecting surface that partially extends below a girdle of the precious stone and which faces a portion of the pavilion region of the precious stone in spaced relationship thereto, and a portion that protrudes peripherally beyond the girdle of the precious stone, the faceted plate being configured to reflect light that emanates from the pavilion of the precious stone outwardly and upwardly at a region that peripherally surrounds and extends beyond the precious stone to create a light reflection pattern that produces a visual effect of the precious stone being larger in a peripheral dimension thereof than it actually is.

Preferably, the faceted plate upper surface has an associated angle of inclination that is in the range from 15° to 30° relative to a horizontal plane associated with the setting and the precious stone is a diamond. Also, the faceted plate has a diametrical size that is about 20% to 35% larger than a diametrical size associated with the diamond, or the range can be 23% to 33% larger than the corresponding diametrical size of the diamond. Preferably, the reflecting surface of the faceted plate is coated with rhodium. Preferably, the holding portion of the setting body comprises a plurality of prongs and wherein the faceted plate comprises a plurality of openings for the passage thereto of said prongs, and said prongs engaging said diamond at the girdle thereof.

Preferably, the faceted plate comprises a plurality of faceting structures including a first structure type comprising a partially pyramidal features that are angularly inclined and reduce in cross-sectional size in a direction towards the central opening of the faceted plate, and also comprises a second type of partially triangular/pyramidal faceting structures that extend in a direction from the central opening of the faceted plate toward a peripheral edge thereof, increasing in cross-sectional size toward the peripheral edge. The partially pyramidal structures formed on the faceted plate are configured to reflect light bouncing off or passing through the pavilion of the diamond in a direction so as to be seen at that portion of the faceted plate which extends beyond the diamond. The faceted plate can be square shaped, oval shaped, marquise cut shaped, cushion shaped, pear shaped or have another shape.

Alternatively, the holding portion comprises a plurality of prongs that extend and engage the faceted plate at a plurality of peripheral edge locations thereon. The faceted plate may have a diametrical size of 3.9 mm, 5.0 mm and 6.3 mm, corresponding to a diametrical size of the diamond being 3.0 mm, 4.0 mm and 5.0 mm, respectively. Preferably, the diamond is supported by the jewelry setting without contacting any surface of the faceted plate. The faceting structures may be formed by CNC cutting of the faceted plate, to render the faceted surfaces to very precisely defined dimensions.

Other features and advantages of the present invention will become apparent from the following description of the invention which refers to the accompanying drawings.

DETAILED DESCRIPTION OF EMBODIMENTS OF THE INVENTION

Figure 1:
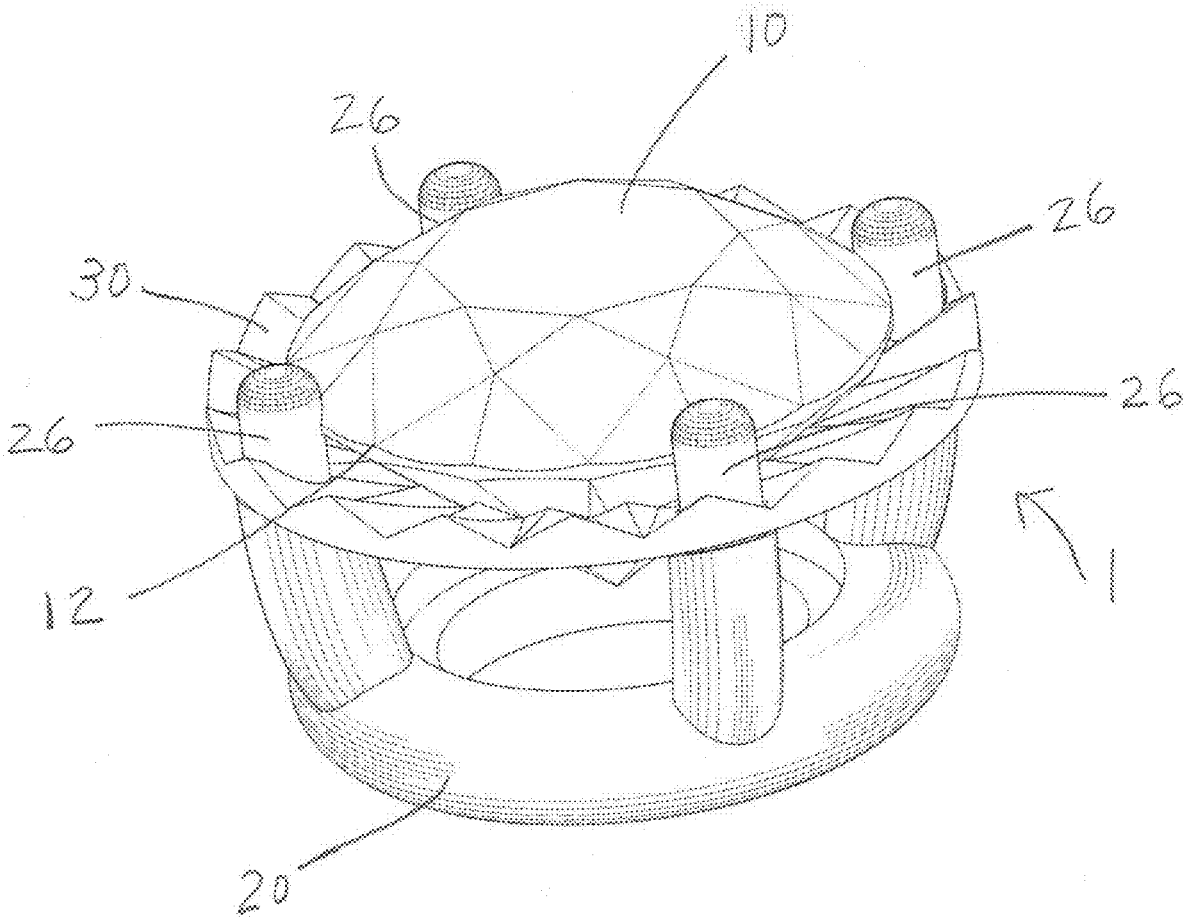
FIG. 1 is a perspective of the size enhancing diamond setting in accordance with an embodiment of the present invention.

Referring to FIG. 1, the overall diamond setting 1 includes an otherwise conventional round diamond 10 that is supported by a setting 20, which setting has four prongs 26 that firmly hold the diamond at its girdle 12 in conventional manner.

In departure from the prior art, the setting 1 includes a size enhancing disc 30 that, as described later, contains various faceting and extends in spaced relationship to the diamond 10, below the pavilion 14 of the diamond. As explained in more detail further on, owing to the disc 30 having a diametrical size that is about 20%-35% larger than that of the diamond 10 and the located of a portion of the disc 30 below and spaced away from the diamond's pavilion, the light reflection patterns projected by the disc 30 around the girdle of the diamond is similar to that of the diamond 10. Hence, the overall appearance is that of a larger sized diamond, including because the line of demarcation between the disc 30 and the diamond 10 is difficult to discern.

In exploded FIG. 2, the conventional diamond 10 is shown to have a girdle 12, a pavilion 14 extending obliquely inward below the girdle and a top portion 16 comprising the diamond's crown and table regions. The setting 20 has a ring-shaped base 22, at which the setting can be soldered or otherwise fixed to a jewelry piece, e.g., a ring, pendant and the like, with a central, light admitting passage 25 and four prongs 24 extending upwardly and terminating in a smaller diameter diamond holding sub-prongs 26, each of which has an interiorly facing groove 28. Thereby, when the diamond 10 is squeezed between the four prongs, its girdle 12 snaps into the grooves 28 and so becomes steadily supported and secured to the setting 20.

The innovative size enhancing disc 30 similarly has a central opening 38 through which the pavilion 14 of the diamond 10 can pass, preferably without touching the disc 20 and while leaving a space between the pavilion's surface and the faceted surfaces at the top of the frustoconically shaped disc 30.

Figure 6:
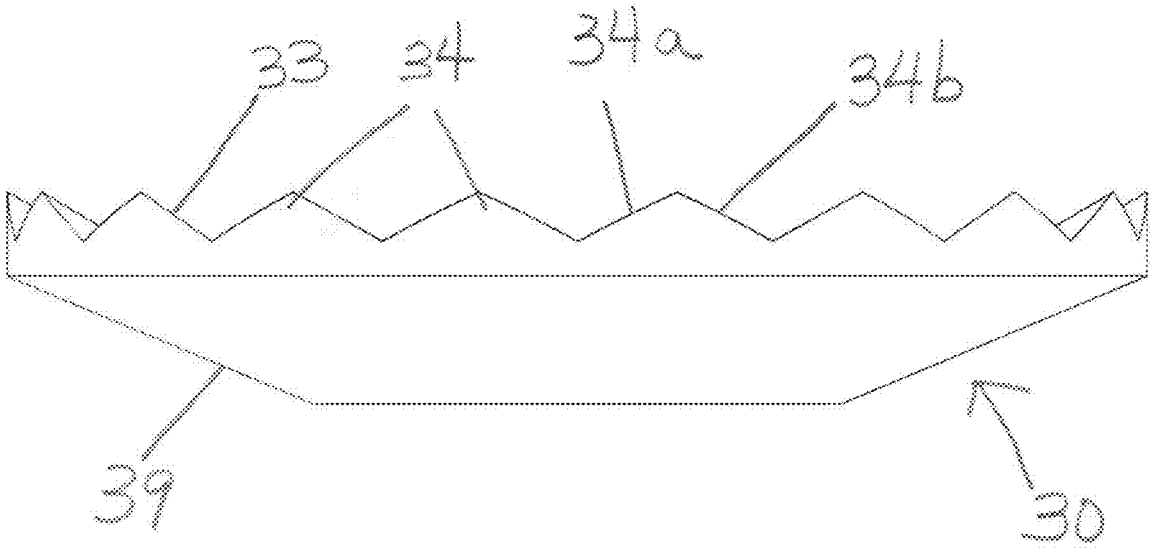
FIG. 6 is a side view of an embodiment of the size enhancing disc component of the present invention.
Figure 7:
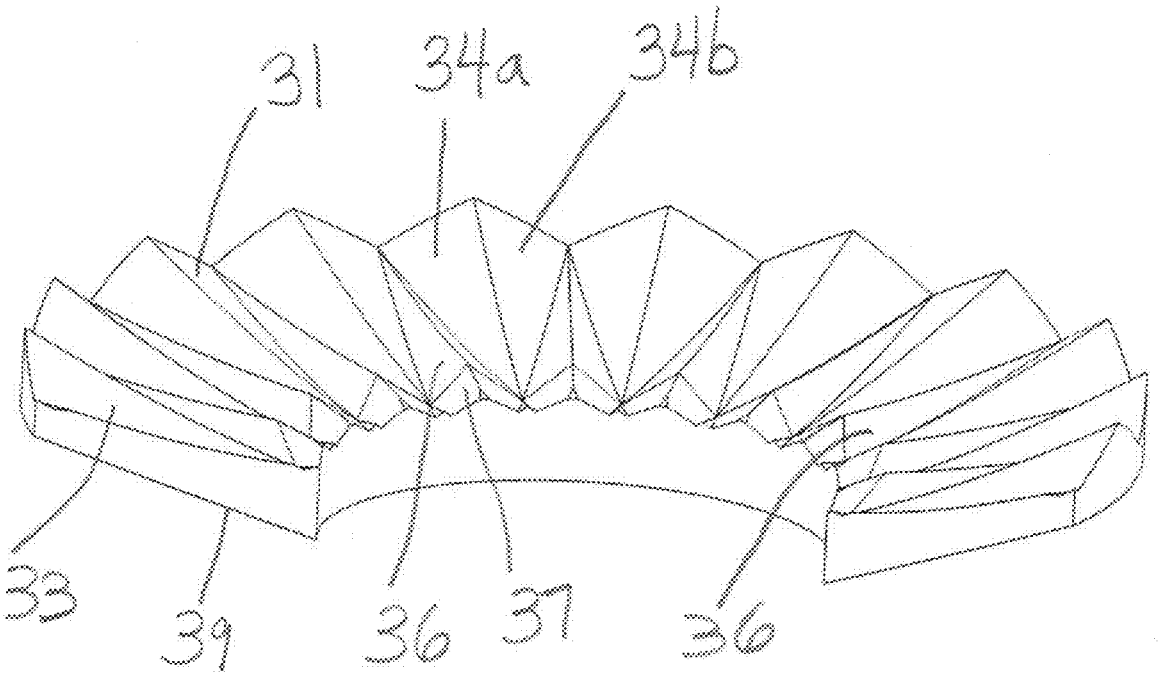
FIG. 7 is a perspective of a section of the size enhancing disc of the present invention.
Figure 8:
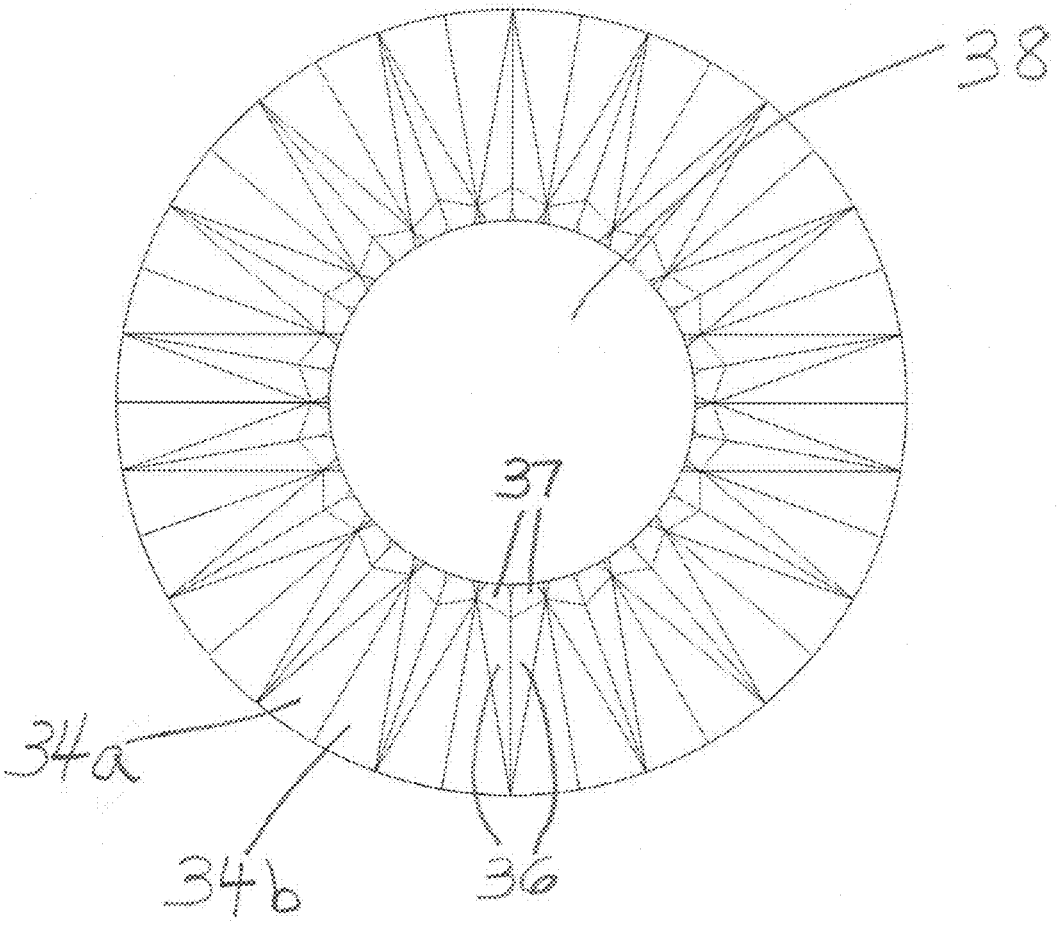
FIG. 8 is a top view of FIG. 6.

FIGS. 6-8 depict the faceting that is imported to the top surface of the disc 30 which has the side view shape shown in FIG. 6. As depicted, an outer wall 39 of the disc 30 extends at a slant of approximately 15°-28° relative to the horizontal, more preferably, at 18°-25°. The faceted interior overall surface 33 has substantially the same inclination angle, which inclination angle is similar to the inclination angle of the pavilion 14. These angles are taken relative to the horizontal, for example, relative to the plane of the table of the diamond 10.

The concave, e.g. inwardly slanting top surface of the disc 30 is formed with various diamond cut and light reflecting surfaces that are formed or cut with high speed precision CNC machinery using a diamond tool. The disc 30 is formed from metallic material, preferably steel and after the patterns have been formed thereon, the upper surface is plated with rhodium to give it a high sheen and a color that would match the light color and sparkle that is typically produced by a diamond. The faceted surfaces create an upward and outward directed, arrow style pattern on the top surface 37 that results from the very highly reflective surface at the top of the disc 30.

More specifically and with reference to FIGS. 6 and 7, the reflecting surface 33 comprises triangular, partially pyramidical features 34 with side-wise inclined surfaces 34*a* and 34*b* on opposed sides of the line 31, which is inclined toward the center of the disc 30 at the mentioned angle of about 18 to 25 degrees. In addition, differently shaped triangular, pyramidical structures 36 extend from the bottom/center upwards as shown in FIG. 7, with the edges thereof further angularly cut to produce the edge features 37. The general surface inclines as noted previously are at an angle that roughly matches that of the pavilion of the diamond, but the surface is in spaced away from the diamond. See the same faceted features in the top view FIG. 8.

Figure 3:
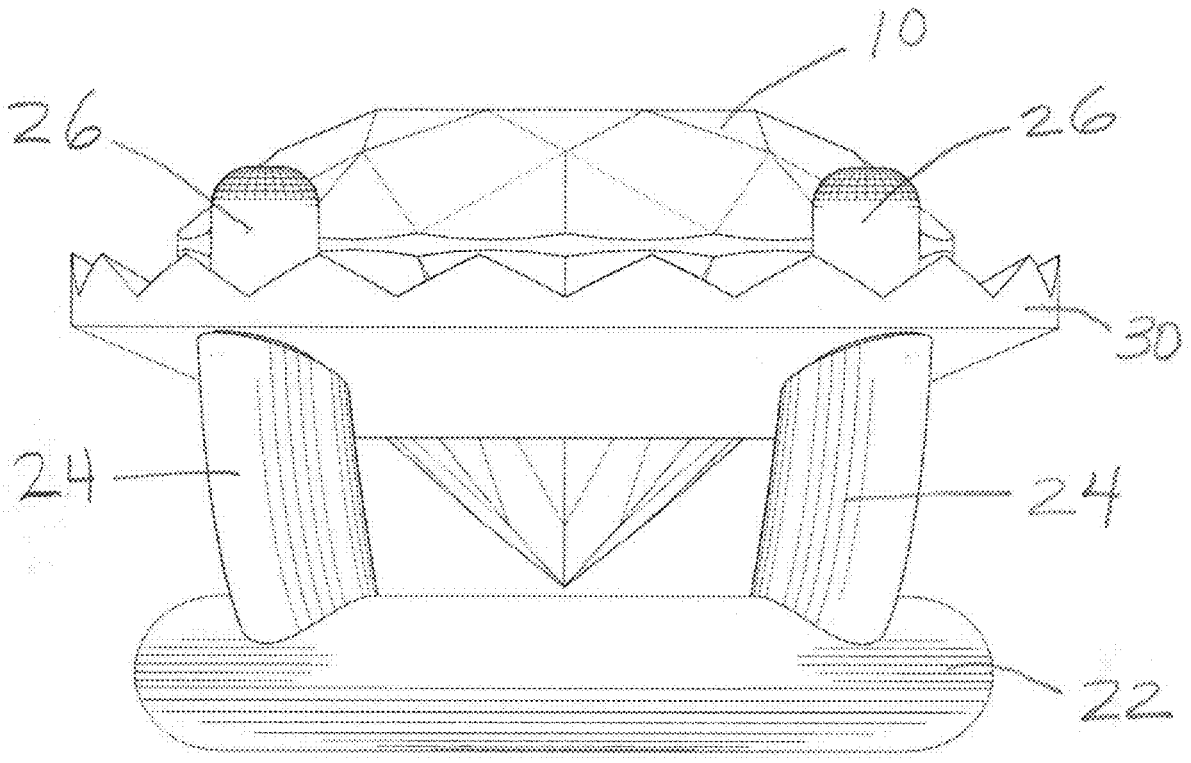
FIG. 3 is a side view of FIG. 1.
Figure 4:
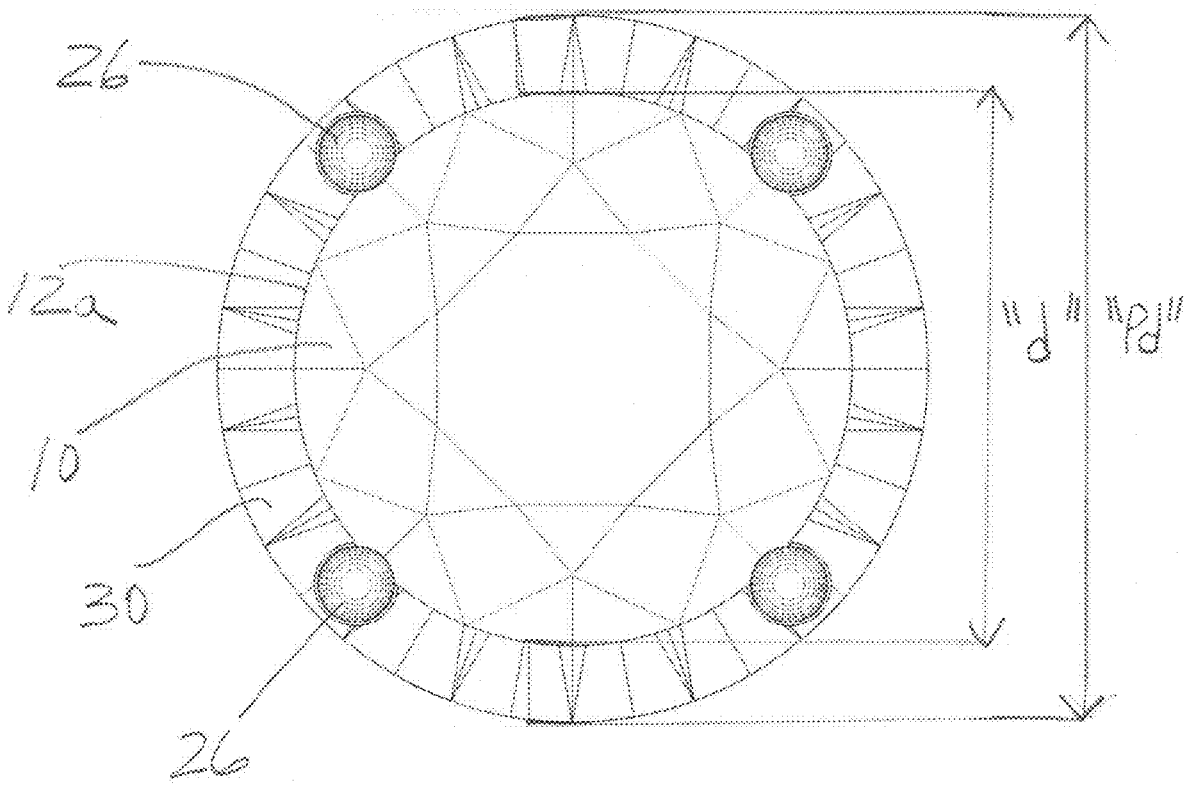
FIG. 4 is a top view of FIG. 1.

As can be appreciated from FIGS. 3 and 4, the outer peripheral edge of the diamond, specifically, the edge of the girdle 12, reaches approximately halfway between the center periphery and the outer periphery of the disc 30 so that the exposed portion of the disc 30 that extends beyond the diamond 10 and so is able to receive and reflect outwardly and upwardly light that impinges on the diamond 10 from above or below the diamond and reflected outwardly from the pavilion 14 onto the disc 30. The disc 30 matches and redirects the diamond's light pattern (created by the diamond's numerous facets) resulting in an effect that makes it almost impossible to detect the edge 12*a* of the diamond's girdle in the overall setting. As further indicated in FIG. 4, the diametrical size "pd" is approximately 20%-35% larger than the diametrical size "d" of the diamond 10, which results in a perceived weight caratage increase of approximately double that of the actually provided diamond. For example, the table below shows the effects of the size enhancing disc 30 relative to diamonds of different weight caratage, for example 0.10, 0.25, and 0.50 carats.

| Actual diamond wt (carat size) | millimeter size of Actual Diamond (diameter) | millimeter size of Size Enhancer Disc (diameter) | Enhanced Size equivalent to (carat size) | Size Enhancement Remark |
|---|---|---|---|---|
| 0.10 ct | 3.0 mm | 3.9 mm | 0.40 ct | 0.10 ct diamond looks like 0.20 ct |
| 0.25 ct | 4.0 mm | 5.0 mm | 0.50 ct | 0.25 ct diamond looks like 0.50 ct |
| 0.50 ct | 5.0 mm | 6.3 mm | 1.00 ct | 0.50 ct diamond looks like 1.00 ct |

Figure 2:
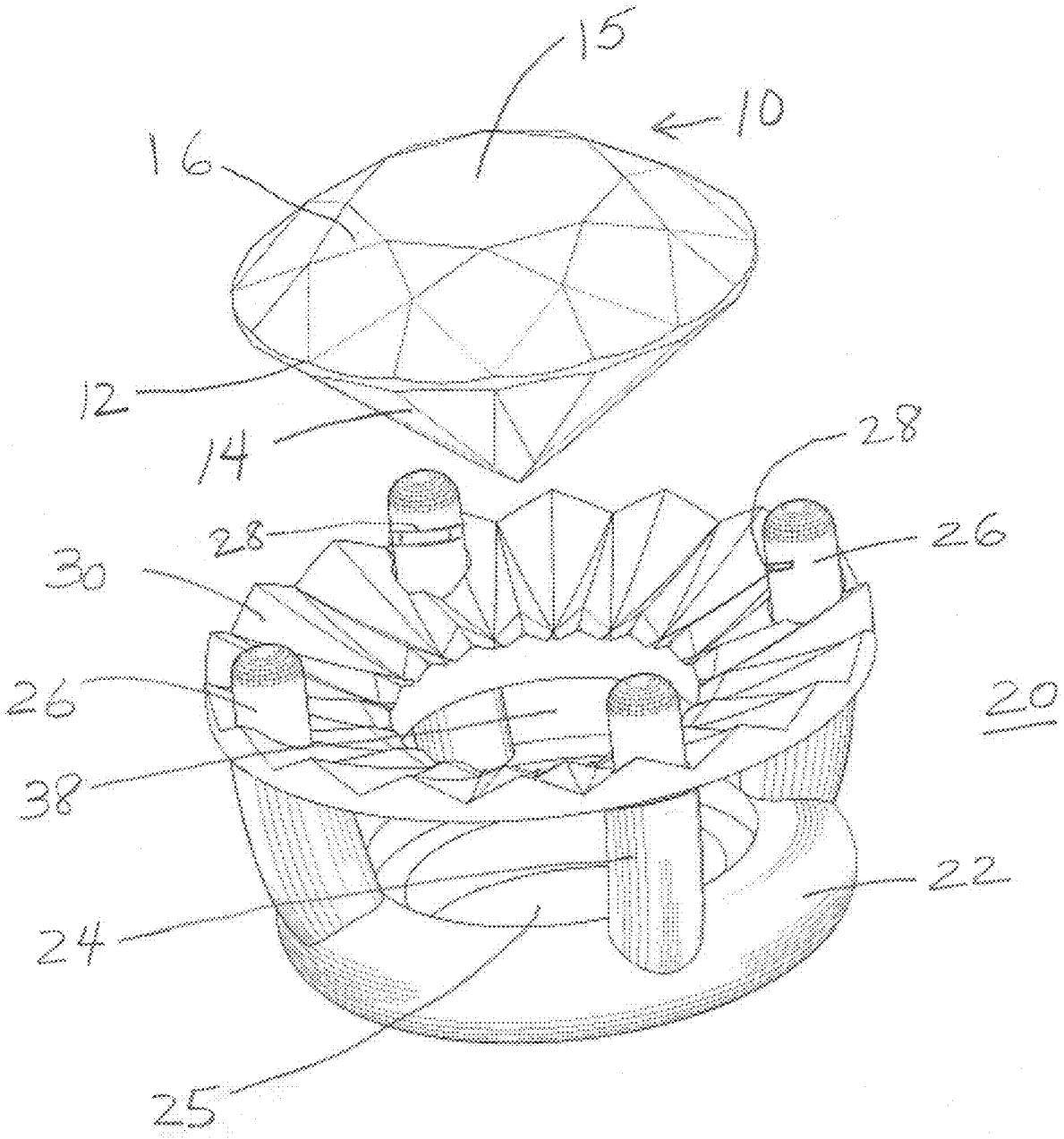
FIG. 2 is an exploded perspective of FIG. 1, with the diamond raised above the setting.
Figure 5:
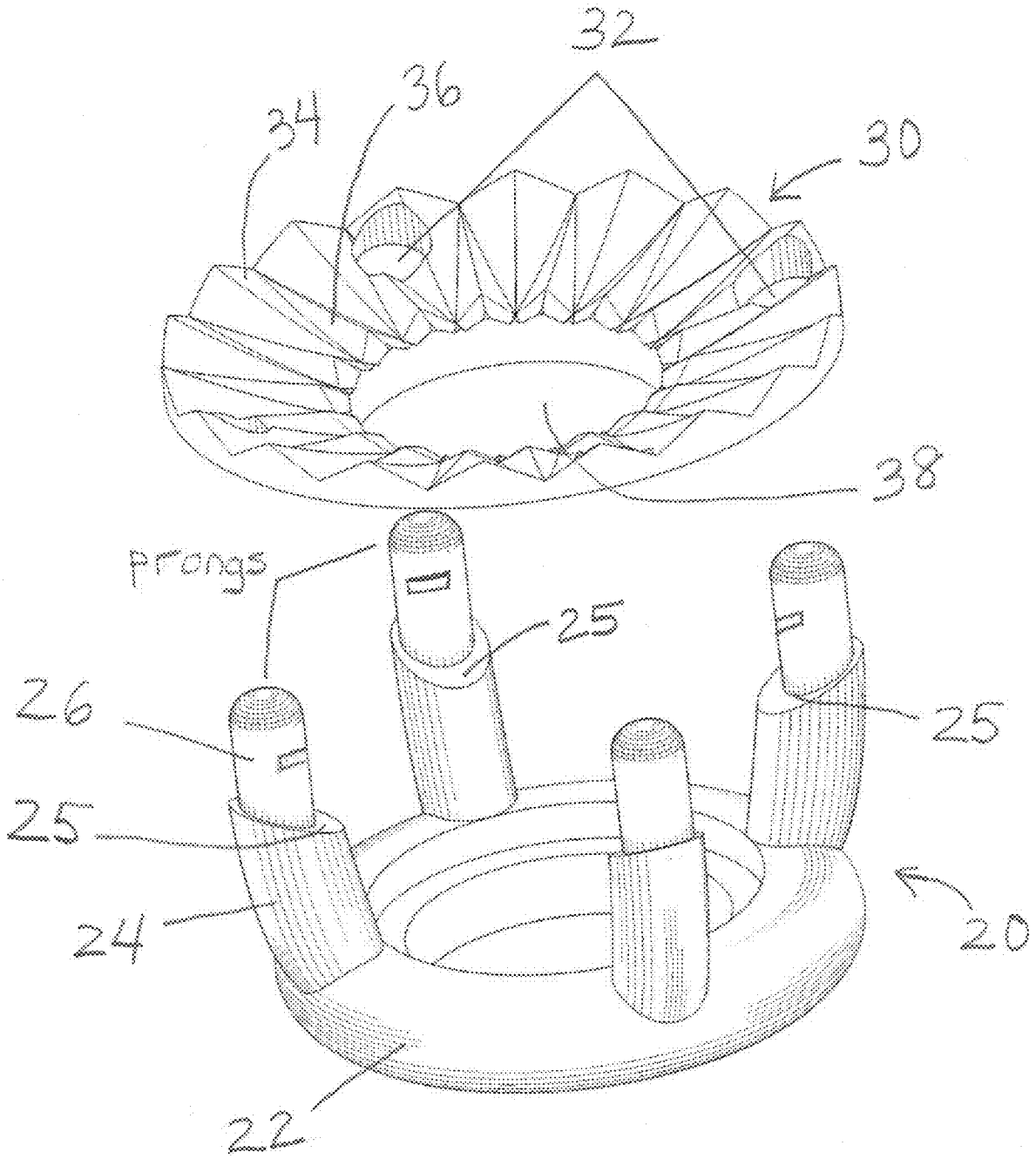
FIG. 5 is an exploded view of the bottom portion of FIG. 2.

In a preferred embodiment according to the present invention, the disc 30 shown in FIG. 5 has four openings 32 that match the location of the sub-prongs 26 in FIG. 2 and furthermore, the base prong 24 narrows in size to create a sub-prong 26, leaving an outer peripheral inclined resting step or shoulder 25 that matches the bottom contour of the disc 30 so that it rests solidly on the step 25. Using laser soldering, the disc 30 can be soldered to the base setting 20.

Figure 10:
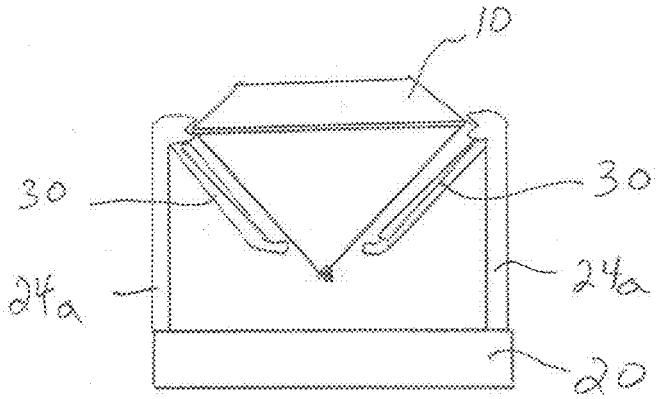
FIG. 10 is diagrammatically illustrates a size enhancing bezel with the supporting prongs located on its peripheral edge(s).

While an embodiment of the invention has been described above in which the plate/disc 30 has been formed with holes 32 for the passage of the prongs 26 thereto, the invention can be further implemented in an embodiment in which the prongs 24*a* and 24*b* extend on the outside of the disc 32. In this embodiment, the distal ends of the prongs 26 are inwardly bent toward the diamond to hold the diamond. See FIG. 10. Also, as described above, the diamond 10 does not actually touch any surface of the disc 30. But in other embodiments, the pavilion of the diamond may contact the interior surface that defines the center hole in the plate/disc 30. See for example the diagrammatically rendered FIG. 10.

Figure 9:
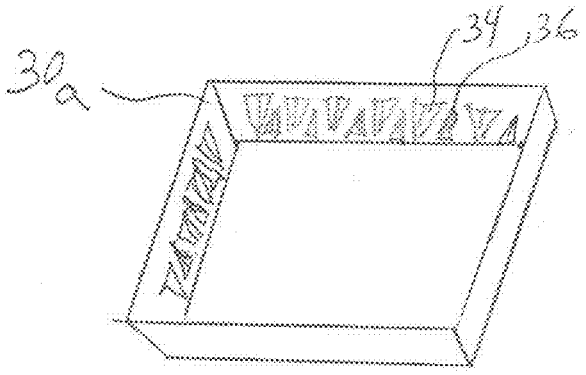
FIG. 9 is a perspective of a square-shaped size enhancing bezel for a diamond jewelry setting.

In the same vein, while the embodiment of the invention has been described above relative to a round diamond 10, the disc plate can be implemented in a square shape or in other shapes to match a differently cut diamond, for example, square diamonds, cushion shaped diamonds, princess cut diamonds and virtually any diamond shape to achieve the effects of the present invention as illustrated schematically, for example, in FIG. 9 for a square plate 30*a*. Similarly, while the setting 20 described above is of the type that uses a plurality of prongs to hold the diamonds, there are other settings, for example barrel settings and the like with which the bezel/disc 30 may be used. In a barrel setting, the diamond may be supported by forming notches at several locations around its pavilion and providing four more protrusions or tongues in the barrel that snap into the notches to hold and support the diamond, in spaced relationship thereto, as described above.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A size enhancing jewelry setting for a precious stone, the setting comprising:

a setting body including a holding portion that is configured to engage and hold the precious stone affixed to the setting body; and a faceted plate supported by the setting body, the faceted plate having a central opening for the passage of a pavilion region of the precious stone therethrough, an upward facing reflecting surface that partially extends below a girdle of the precious stone and which faces a portion of the pavilion region of the precious stone in spaced relationship thereto, and a portion that protrudes peripherally beyond the girdle of the precious stone, the faceted plate being configured to reflect light that emanates from the pavilion of the precious stone outwardly and upwardly at a region that peripherally surrounds and extends beyond the precious stone to create a light reflection pattern that produces a visual effect of the precious stone being larger in a peripheral dimension thereof than it actually is; and wherein the holding portion of the setting body comprises a plurality of prongs and wherein the faceted plate comprises a plurality of openings for the passage thereto of said prongs, and said prongs engaging said diamond at the girdle thereof, in such manner that an outer periphery of the faceted plate is generally aligned with the girdle of the precious stone and a notional planeresting on the faceted plate is positioned substantially closer to the girdle of the precious stone than to the culet of the precious stone.

2. The jewelry setting of claim 1, wherein the faceted plate upper surface has an associated angle of inclination that is in the range from 15° to 30° relative to a horizontal plane associated with the setting.

3. The jewelry setting of claim 2, wherein the angle of inclination is from 18° to 25°.

4. The jewelry setting of claim 1, wherein the precious stone is a diamond.

5. The jewelry setting of claim 4, wherein the faceted plate has a diametrical size that is about 20% to 35% larger than a diametrical size associated with the diamond.

6. The jewelry setting of claim 5, wherein the diametrical size of the faceted plate is 23% to 33% larger than the corresponding diametrical size of the diamond.

7. The jewelry setting of claim 4, wherein the reflecting surface of the faceted plate is coated with rhodium.

8. The jewelry setting of claim 4, wherein the faceted plate comprises a plurality of faceting structures including a first structure type comprising a partially pyramidical features that are angularly inclined and reduce in cross-sectional size in a direction towards the central opening of the faceted plate.

9. The jewelry setting of claim 8, wherein the faceted plate comprises a second type of partially triangular/pyramidical faceting structures that extend in a direction from the central opening of the faceted plate toward a peripheral edge thereof, increasing in cross-sectional size toward the peripheral edge.

10. The jewelry setting of claim 9, wherein the partially pyramidical structures formed on the faceted plate are configured to reflect light bouncing off or passing through the pavilion of the diamond in a direction so as to be seen at that portion of the faceted plate which extends beyond the diamond.

11. The jewelry setting of claim 8, wherein the faceting structures are formed by CNC cutting of the faceted plate.

12. The jewelry setting of claim 4, wherein the faceted plate has one of a square shape, an oval shape, a marquise cut shape, a cushion shape and a pear shape.

13. The jewelry setting of claim 4, wherein the holding portion comprises a plurality of prongs that extend and engage the faceted plate at a plurality of peripheral edge locations thereon.

14. The jewelry setting of claim 13, wherein the prongs have ends that engage the girdle of the diamond.

15. The jewelry setting of claim 4, wherein the faceted plate has a diametrical size of 3.9 mm, 5.0 mm and 6.3 mm, corresponding to a diametrical size of the diamond being 3.0 mm, 4.0 mm and 5.0 mm, respectively.

16. The jewelry setting of claim 4, wherein said diamond is supported by said jewelry setting without contacting any surface of said faceted plate.

* * * * *